US008830125B1

(12) United States Patent
Strassner, II

(10) Patent No.: US 8,830,125 B1
(45) Date of Patent: Sep. 9, 2014

(54) COMPACT ANTENNA ARRAYS WITH WIDE BANDWIDTH AND LOW SIDELOBE LEVELS

(75) Inventor: Bernd H. Strassner, II, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 425 days.

(21) Appl. No.: 12/728,735

(22) Filed: Mar. 22, 2010

(51) Int. Cl.
*H01Q 1/38* (2006.01)
*H01Q 21/00* (2006.01)

(52) U.S. Cl.
USPC ..... 343/700 MS; 343/853

(58) Field of Classification Search
CPC ..... H01Q 21/065; H01Q 21/0075
USPC ..... 343/873
See application file for complete search history.

(56) References Cited

U.S. PATENT DOCUMENTS

| | | | | |
|---|---|---|---|---|
| 4,555,706 | A | 11/1985 | Haupt | |
| 5,223,850 | A * | 6/1993 | Branigan et al. | 343/771 |
| 5,661,494 | A * | 8/1997 | Bondyopadhyay | 343/700 MS |
| 5,870,057 | A * | 2/1999 | Evans et al. | 343/700 MS |
| 6,492,947 | B2 * | 12/2002 | Anderson | 343/700 MS |
| 7,082,294 | B2 * | 7/2006 | Denis et al. | 455/260 |
| 7,167,129 | B1 * | 1/2007 | Strassner, II | 343/700 MS |
| 7,675,466 | B2 * | 3/2010 | Gaucher et al. | 343/700 MS |

OTHER PUBLICATIONS

Soltysiak et al, "Design of Broadband Transitions from Microstrip to Slotline", Electronics Letters, Feb. 17, 1994, vol. 30, No. 4, pp. 328 and 329.
Schuppert, "Microstrip/Slotline Transitions: Modeling and Experimental Integration" IEEE Transactions on Microwave Theory and Techniques, vol. 36, No. 8, Aug. 1988 pp. 1272-1282.
Kidder et al, "Broad-Band U-Slot Patch Antenna with a Proximity-Coupled Double Pi-shaped Feed Line for Arrays",IEEE Antennas and Wireless Propagation Letters,vol. 1, 2002, p. 2-4.
Li et al, "Ultra-Wideband (UWB) Bandpass Filters with Hybrid Microstrip/Slotline Structures", IEEE Microwave and Wireless Components Letters,vol. 17, No. 11,Nov. 2007, pp. 778-780.

* cited by examiner

*Primary Examiner* — Dameon E Levi
*Assistant Examiner* — Hasan Islam
(74) *Attorney, Agent, or Firm* — Scott B. Stahl

(57) ABSTRACT

Highly efficient, low cost, easily manufactured SAR antenna arrays with lightweight low profiles, large instantaneous bandwidths and low SLL are disclosed. The array topology provides all necessary circuitry within the available antenna aperture space and between the layers of material that comprise the aperture. Bandwidths of 15.2 GHz to 18.2 GHz, with 30 dB SLLs azimuthally and elevationally, and radiation efficiencies above 40% may be achieved. Operation over much larger bandwidths is possible as well.

24 Claims, 7 Drawing Sheets

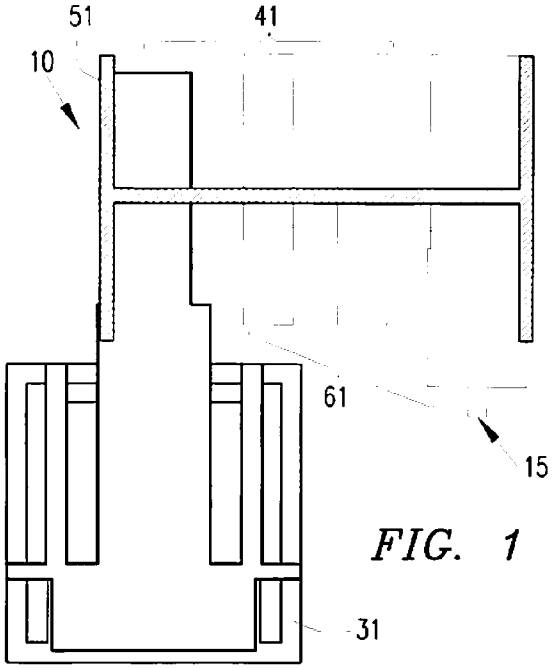
FIG. 1
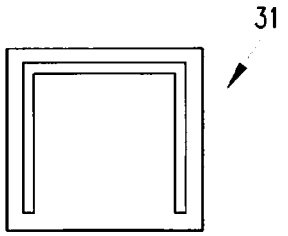
FIG. 3
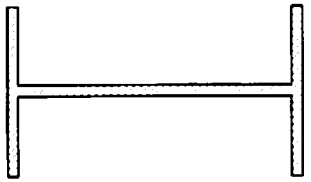
FIG. 5
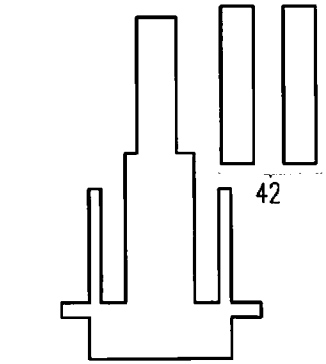
FIG. 4
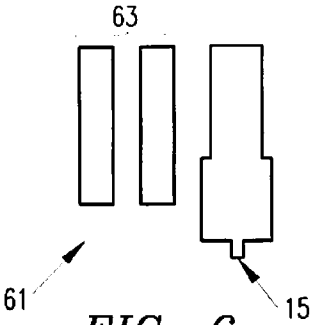
FIG. 6
| | |
|---|---|
| Dielectric Cover | 10 mil Rogers Duriod 5880 |
| U-Slot Patch 31 | 31 mil Rogers Duriod 5880 |
| Embedded Microstrip 41 | 20 mil Rogers Duriod 5880 |
| Ground with Slotline 51 | 31 mil Rogers Duriod 5880 |
| Stripline Feed 61 | 31 mil Rogers Duriod 5880 |
| Ground 21 | 31 mil Rogers Duriod 5880 |
stripline
FIG. 2

COMPACT ANTENNA ARRAYS WITH WIDE BANDWIDTH AND LOW SIDELOBE LEVELS

This invention was developed under Contract DE-AC04-94AL85000 between Sandia Corporation and the U.S. Department of Energy. The U.S. Government has certain rights in this invention.

FIELD OF THE INVENTION

The invention relates generally to communications and, more particularly, to antenna arrays that support synthetic aperture radar (SAR).

BACKGROUND OF THE INVENTION

The radiation characteristics of an antenna are typically determined by the communication system that it supports. An antenna may consist of a single radiator or may include many radiators acting in concert together to form a phased array. Examples of functionalities provided by phased array antennas include increased gain, conformality, sidelobe level (SLL) control, and electronic steering. The SLL is the decibel level difference between the peak of the biggest radiation lobe outside of the main antenna beam and the peak of the main beam itself.

A need has arisen for a SAR (synthetic aperture radar) antenna array that achieves high radiation efficiency while exhibiting low SLL performance. The low SLL requirement has been driven, for example, by the GMTI (Ground Moving Target Identification) mode of SAR operation, wherein the SAR uses the Doppler shift associated with a moving object to track that object's movement. It is therefore desirable to provide for such an antenna array.

BRIEF DESCRIPTION OF THE DRAWINGS

FIG. 1 diagrammatically illustrates a radiator unit cell according to exemplary embodiments of the invention.

FIG. 2 is a diagrammatic cross-sectional view of stacked layers within the radiator unit cell of FIG. 1 according to exemplary embodiments of the invention.

FIGS. 3-6 diagrammatically illustrate respective components of the radiator unit cell of FIG. 1 according to exemplary embodiments of the invention.

DETAILED DESCRIPTION

Figure 7:
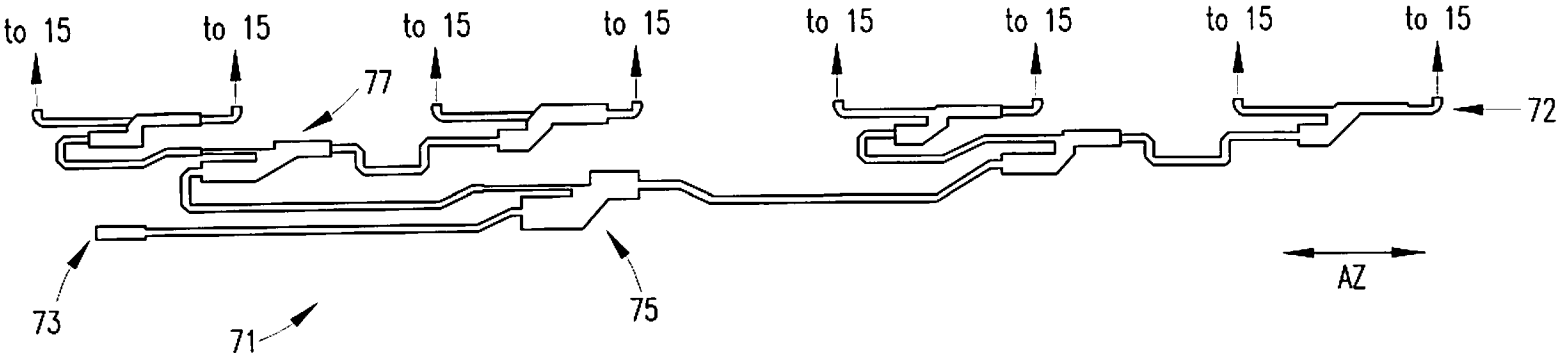
FIG. 7 diagrammatically illustrates a portion of an azimuth plane stripline feed network according to exemplary embodiments of the invention.

Exemplary embodiments of the invention provide highly efficient, low cost, easily manufactured SAR antenna arrays with lightweight low profiles, large instantaneous bandwidths and low SLL. The array topology provides all necessary circuitry within the available antenna aperture space and between the layers of material that comprise the aperture. Some embodiments provide bandwidths of 15.2 GHz to 18.2 GHz, with 30 dB SLLs azimuthally and elevationally, and radiation efficiencies above 40%. Some embodiments operate over much larger bandwidths. Large instantaneous bandwidths make simultaneous modes of operation possible.

FIG. 1 is a plan view of a single radiator unit cell 10 according to exemplary embodiments of the invention. The unit cell 10 of FIG. 1 includes a stripline-to-slotline-to-buried microstrip transition, and a proximity-coupled U-slot patch radiator. The use of proximity coupling provides for increased manufacturability and reliability relative to conventional via-interconnects. The stripline feed portion 61 is also shown in FIG. 6. The stripline port 15 provides connectivity between the unit cell 10 and a stripline feed network of the array. The H-shaped slotline portion 51 is also shown in FIG. 5. The buried (or embedded) microstrip portion 41 is also shown in FIG. 4. The U-slot patch radiator 31 is also shown in FIG. 3.

The unit radiator cell 10 of FIG. 1 tends to isolate the feed network from the U-slot patch radiator 31 except where the power is being distributed from feed network to radiator via the slotline portion 51. In an array with many patch radiators, it is desirable to avoid mutual coupling between the patch radiators and the feed network. Such mutual coupling disadvantageously interferes with the aperture weighting scheme (e.g., a Taylor weighting scheme), resulting in undesirably high SLLs. Exemplary embodiments of the invention use a stripline feed network because the upper ground of the stripline feed portion 61 (see also the diagrammatic cross-sectional view of FIG. 2) serves to isolate the stripline feed network from the U-slot patch radiator 31. The topology of the radiator unit cell 10 is relatively compact, and thus accommodates relatively close in-row spacing, which helps avoid grating lobes.

Energy flows from the stripline port 15 to the H-shaped slotline section 51, which is defined within the upper ground of the stripline feed portion 61 as indicated in FIG. 2. In some embodiments, rectangular strips of metal (copper in some embodiments) in both the stripline layer (see 63 in FIG. 6) and the embedded microstrip layer (see 42 in FIG. 4) help to flatten the slotline passband (15.2 GHz to 18.2 GHz in some embodiments) and minimize insertion losses. In some embodiments, the microstrip portions 42 overlie the stripline portions 63. Thus, only the micro strip portions 42 are visible in the example plan view of FIG. 1. The slotline 51 together with the metal strips 42 and 63 effectively constitute a slotline filter that tends to flatten the passband while providing power transfer from the stripline layer to the microstrip layer (see also FIG. 2). Energy couples up through the slotline 51 to the embedded microstrip 41, through which it proceeds under the patch radiator 31 for proximity coupling thereto. The unit cell structure 10 of FIG. 1 enables the stripline-to-slotline-to-microstrip coupling to be achieved within a relatively compact region. This is advantageous in designs where tight unit cell spacing is desired in order to avoid detrimental grating lobes.

Referring again to FIG. 2, a 10 mil superstrate layer (dielectric cover) acts as a barrier to protect against damage to the radiator 31, and keeps moisture away from the metal (e.g., copper) traces. In some embodiments, all of the Rogers Duroid 5880 layers ($\in_r$=2.2) are bonded using Arlon™ thermoplastic Teflon bonding film. In some embodiments, the total cross-sectional thickness (see FIG. 2) of the antenna structure, including substrates, metallization and bonding film thicknesses is 3.44 mm=135.4 mils=0.1354 in. In some embodiments, the layers shown in FIGS. 1 and 2, together with inter-layer bonding films, are squeezed together under heat and pressure using conventional aluminum fixtures.

As mentioned above, in the unit cell of FIG. 1, the H-shaped slotline section 51 in the upper ground of the stripline (see also FIG. 2) separates the stripline feed network from the U-slot patch radiator 31, which tends toward minimal coupling between the feed network and radiator. Stripline is also a relatively efficient transmission line medium that advantageously provides relatively good low loss performance. The stripline feed network thus permits a relatively well-controlled feed network design that in turn produces relatively high radiating efficiencies and low SLLs.

Some embodiments provide a planar antenna array having sixteen radiator unit cells 10 in the x or azimuth (AZ) direction and twelve radiator unit cells 10 in the y or elevation (EL) direction. Thus, each antenna array aperture contains 16×12=192 radiator unit cells 10. In some embodiments, the azimuth direction spacing between adjacent radiator unit cells is 9.6 mm and the elevation direction spacing is 13.8 mm. Various embodiments use various combinations of AZ and EL spacing dimensions based on the array size needed to produce a desired gain, the spacing necessary to avoid grating lobes, and the area available for the antenna topology as dictated by radome and gimbal size limitations. Increasing the spacing between radiator unit cells will increase the overall radiating efficiency of the array, but at some point the appearance of grating lobes at the highest radiating frequency will impose a constraint on unit cell spacing. Grating lobes result in significant SAR image quality degradation.

The Appendix contains a table of Taylor-weighted aperture coefficients used in some embodiments with the aforementioned radiator unit cell count and spacing. These are ideal weights generated by commercially available MATLAB code, and are used to design the array feed networks in various embodiments. The rows and columns of the table correspond to the physical positions of the radiators in the rows and columns of the array, with the AZ direction of the array corresponding to left/right in the table, and the EL direction of the array corresponding to up/down in the table. It can thus be seen that the innermost four radiators of the array get the highest power, while the radiators at the corners of the array get the lowest power. All of the aperture weights are normalized to the weights of the innermost four radiators. The weights shown in the table are voltage weights. Power weights are simply the square of the corresponding voltage weights.

The example 16×12 array of radiator unit cells 10 described above is a two-dimensional planar array having a rectangular lattice arrangement with the radiator unit cell 10 of FIG. 1 as the building block of the lattice. The array has two orthogonal planes of interest, the AZ plane and the EL plane. Because of the rectangular lattice arrangement of the array, the worst case SLLs will lie within these principal plane cuts.

FIG. 7 diagrammatically illustrates a portion 71 of an AZ-plane stripline feed network for an antenna array according to exemplary embodiments of the invention. The AZ-plane stripline feed network is positioned between two 31 mil Rogers Duroid 5880 layers, as shown in FIG. 2. The portion 71 of FIG. 7 constitutes a splitter having an input port 73 and eight output ports designated generally at 72, and thus constitutes one-half of a complete AZ-plane network that feeds sixteen radiator unit cells 10 in one of the twelve rows of the array. In some embodiments, all nine ports are 100 ohm ports. The eight output ports at 72 feed eight respectively corresponding input ports 15 of eight respectively corresponding radiator unit cells 10 (see also FIG. 1). To achieve the 9.6 mm azimuth spacing between radiator unit cells 10 as described above, the eight output ports 72 are spaced 9.6 mm from one another. The feed network portion 71 is a reactively-matched feed network designed to support implementation of the aforementioned Taylor weights. A reactively-matched network, in contrast to a conventional Wilkinson-based network, does not employ resistors. Resistors disadvantageously present undesirable losses that ultimately reduce the overall efficiency of the array.

In order to provide phase balance across the aperture, it is ideally desirable for the energy to arrive at all input ports 15 of the respective radiator unit cells 10 at the same time. This means that the insertion phases must be very close across the entire operational frequency band of the array (3 GHz in some embodiments). The greater the number of severely unbalanced tees (T-shaped splitters, or T-junctions) in the network, the more difficult it is to balance all of the phases. The feed network portion 71 contains two severely unbalanced tees, at 75 and 77, which are relatively more unbalanced than the remaining tees.

Figure 14:
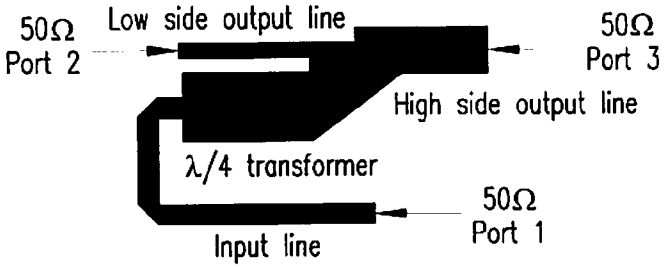
FIG. 14 diagrammatically illustrates an example of a severely unbalanced T-junction such as shown in FIGS. 7 and 8 according to exemplary embodiments of the invention.

The seven unbalanced tees in the stripline feed network portion 71 are bent to fit the array topology, and also to limit phase error that increases the SLLs associated with the array. In the portion 71, the quarter-wave transforming neck of each tee is bent extend alongside and generally parallel to the low-power branch of the tee. This structure virtually eliminates phase error over a significant bandwidth. If no bend is used, the phase would only be balanced at the center frequency (16.7 GHz in some embodiments), with maximum phase errors around 20 degrees at the highest and lowest frequencies. If the quarter-wave transforming neck were bent in the opposite direction to extend alongside and generally parallel to the high-power branch, phase errors would become even worse than if no bend were used. The bending also makes the tee relatively compact in size, which may be advantageous in designs where space is limited. The resulting insertion losses also exhibit very good balance over the bandwidth in which the phase error is removed. An example of the severely unbalanced tee structure described above, with an 85/15 power split, is shown in FIG. 14. It should be noted that, if the example 16×12 array were doubled in size, a reactively-matched network might not be sufficient to provide flat insertion losses and balanced phases as desired, in which case the use of some Wilkinson power dividers in conjunction with reactively-matched sections might be necessary.

Figure 8:
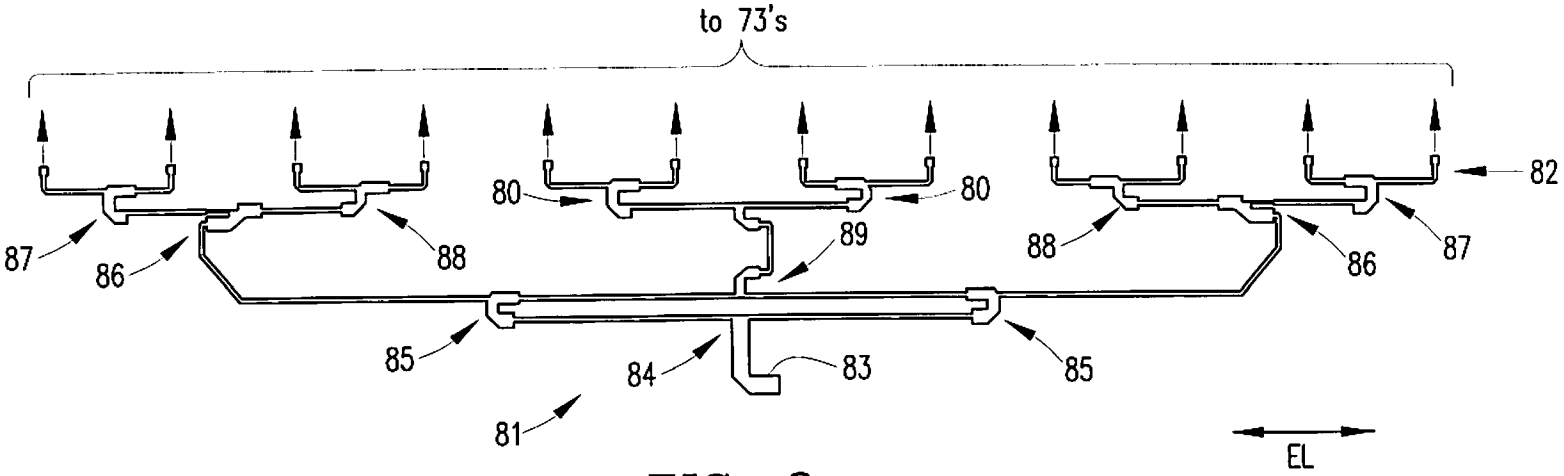
FIG. 8 diagrammatically illustrates a portion of an elevation plane stripline feed network according to exemplary embodiments of the invention.

FIG. 8 diagrammatically illustrates an EL-plane stripline feed network 81 for an antenna array according to exemplary embodiments of the invention. As with the AZ-plane stripline feed network, the EL-plane stripline feed network is positioned between the two 31 mil Rogers Duroid 5880 layers shown in FIG. 2. The network 81 constitutes a splitter having an input port 83 and twelve output ports 82. In some embodiments, the output port 83 is a 50 ohm port and the output ports 82 are 100 ohm ports. Thus, the network 81 does not have $2^n$ output ports as in conventional feed network arrangements. The twelve output ports 82 feed twelve respectively corresponding input ports 73 of twelve respectively corresponding AL-plane feed network portions 71 (see also FIG. 7). To achieve the 13.8 mm elevation spacing between radiator unit cells 10 as described above, the eight output ports 82 are spaced 13.8 mm from one another. The feed network 81 is a reactively-matched feed network designed to support implementation of the aforementioned Taylor weights.

In the feed network 81 of FIG. 8, the power is first split at a balanced (50/50) T-junction 84, and then proceeds left and right to a pair of unbalanced T-junctions 85. The high-power outputs of the unbalanced T-junctions 85 are fed to a 50/50 combiner T-junction 89 that recombines the power that it receives from the T-junctions 85. The output of T-junction 89 is split to feed equally a pair of unbalanced T-junctions 80. The low-power outputs from the T-junctions 85 drive respective inputs of severely unbalanced T-junctions 86 that are relatively more unbalanced than the unbalanced T-junctions 85. The low-power outputs of T-junctions 86 drive respective inputs of severely unbalanced T-junctions 87, and the high-power outputs of T-junctions 86 drive respective inputs of unbalanced T-junctions 88. The severely unbalanced T-junctions 86 are configured in generally the same manner as the severely unbalanced T-junctions of FIG. 7, also shown in FIG. 14. The outputs of the six T-junctions at 80, 87 and 88 feed the twelve output ports 82.

The aforementioned recombination at T-junctions 89 makes the design requirements for the unbalanced T-junctions 85 much less stringent. That is, the T-junctions 85 may be realized with dimensions, particularly on the low-power outputs, that are relatively easily manufactured and result in accurately predictable performance. Realization of Taylor weights such as described above would otherwise typically require the low-power output sides of the unbalanced T-junctions 85 to have very narrow widths, so the T-junctions 85 would be severely unbalanced which, as indicated above, would make the task of balancing phases in the network more difficult. Furthermore, very narrow widths in T-junctions may lead to problems with etching tolerances in the manufacturing process, thereby negatively affecting manufacturability.

Figure 9:
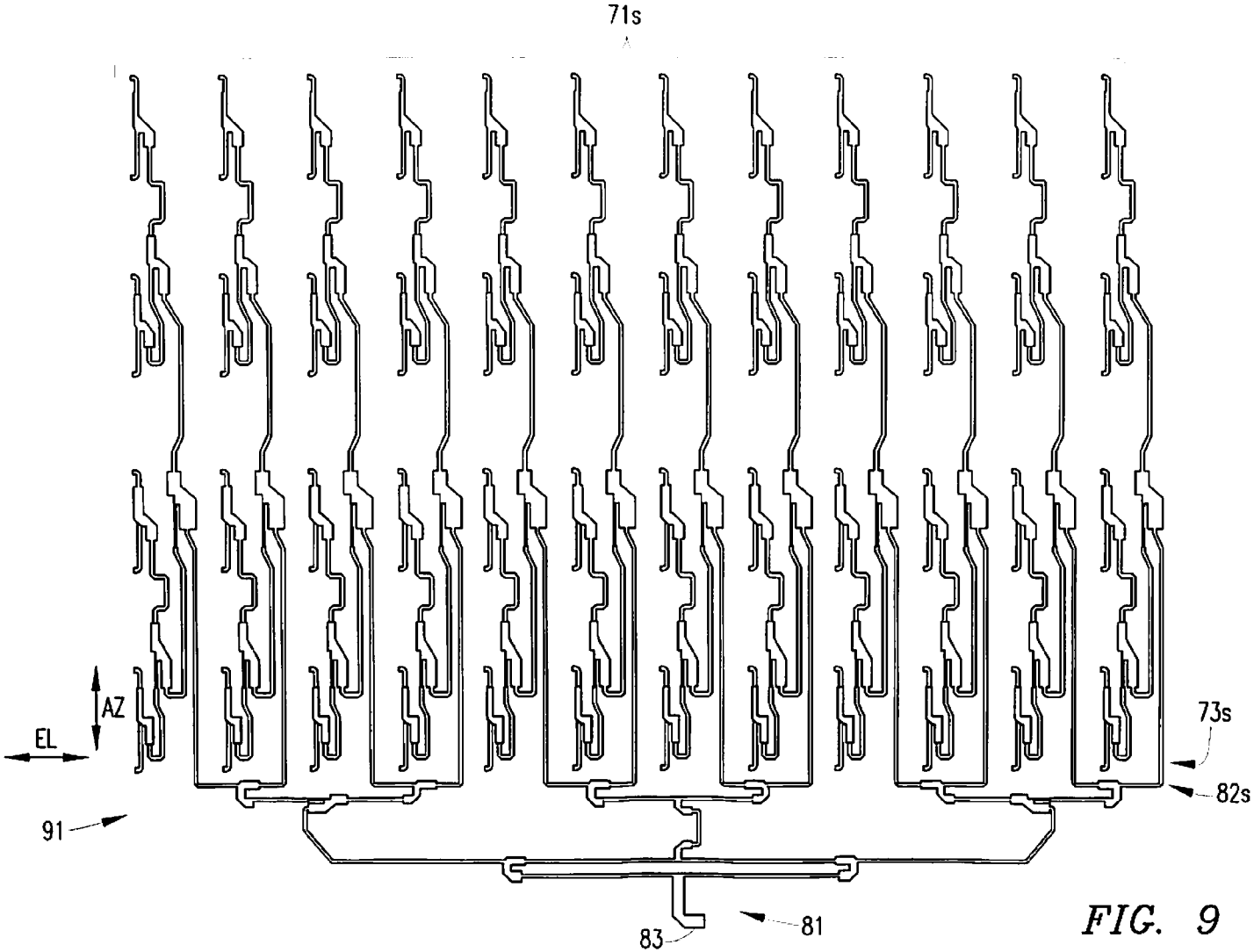
FIG. 9 diagrammatically illustrates one-half of a stripline feed network for an antenna array according to exemplary embodiments of the invention.

FIG. 9 diagrammatically illustrates the EL-plane stripline feed network 81 of FIG. 8 feeding twelve instances of the eight-output AZ-plane stripline feed network portion 71 of FIG. 7. The arrangement 91 of FIG. 9 thus constitutes one-half of the feed network required to drive the aforementioned 16×12 array of radiator unit cells 10. More specifically, the half-network 91 of FIG. 9 is capable of driving eight radiator unit cells 10 in each of the twelve rows of the array. It will be recognized that the AZ-plane network portion 71 is an essentially modular component, such that a given network portion 71 may simply be duplicated eleven times when fabricating the half-network 91.

Figure 10:
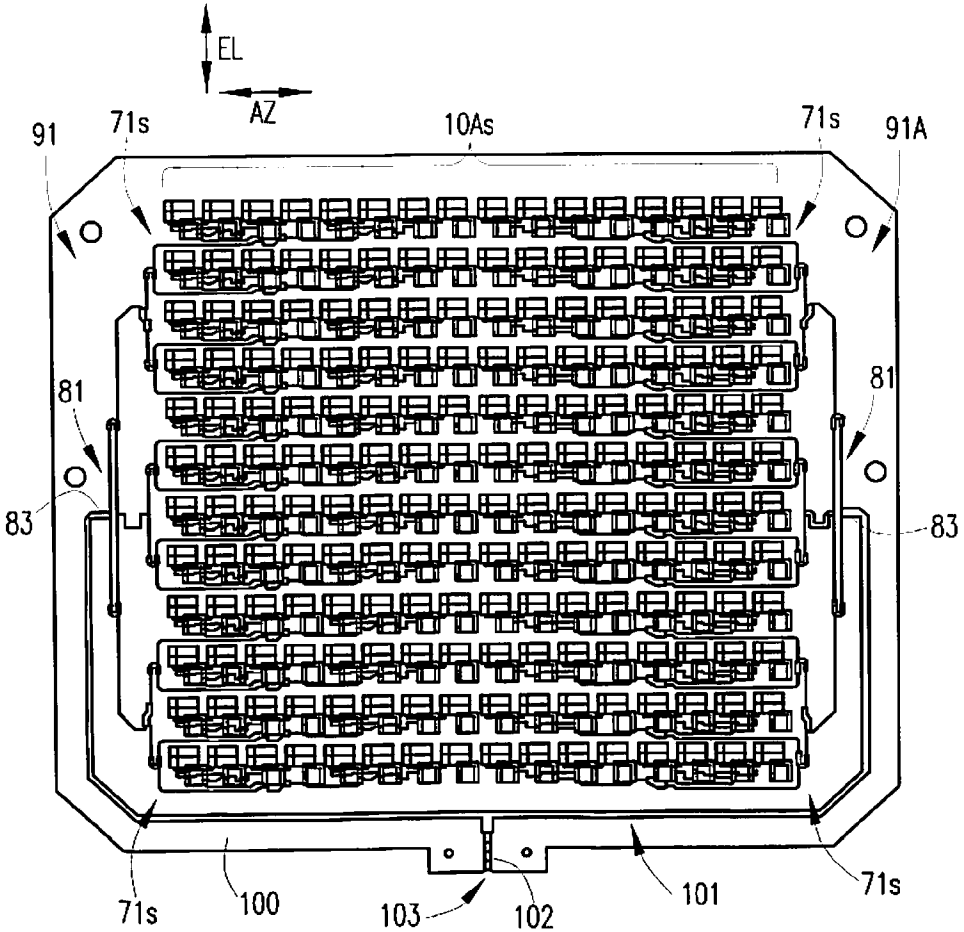
FIGS. 10 and 11 diagrammatically illustrate respective two-dimensional antenna arrays according to exemplary embodiments of the invention.

FIG. 10 diagrammatically illustrates a complete two-dimensional radiator unit cell array according to exemplary embodiments of the invention. The array includes 192 radiator unit cells 10A arranged in twelve rows extending in the AZ direction and sixteen columns extending in the EL direction. The radiator unit cells 10A in the array of FIG. 10 are configured as mirror images of the radiator unit cell configuration shown at 10 in FIG. 1, but are otherwise identical to the radiator unit cell 10. The radiator unit cells 10A of the array are driven by an array stripline feed network including two half-network portions 91 and 91A, and an entry feed network portion 101. Four larger circular openings are provided through the layers of the stack 100 (see also FIG. 2) in the upper half of the structure for use in alignment during fabrication, and two smaller circular openings are provided at the lower center of the structure to facilitate attachment of a power input connector.

The entry feed network portion 101 is a generally U-shaped splitting network that equally splits input power received at an input port 102, and feeds it to the input ports 83 of the AL-plane networks 81 within the two half-networks 91 and 91A. In some embodiments, the input port 102 is a 50-ohm port. In some embodiments, a SMA-to-tab connector (SMA refers to a conventional "SubMiniature version A" coaxial RF connector) provides power to the input port 102. The half-network 91 of FIG. 9 feeds the left half (i.e., the left 12×8 portion) of the array.

The half-network portion 91A that feeds the right half (i.e., the right 12×8 portion) of the array is configured as a mirror image of the half-network configuration shown at 91 in FIG. 9, but is otherwise identical to the half-network 91. In each half-network portion 91 and 91A, the twelve output ports 82 of the EL-plane network 81 (see also FIGS. 8 and 9) feed twelve respectively corresponding input ports 73 of twelve AZ-plane network portions 71 (see also FIGS. 7-9). Further in each half-network portion 91 and 91A, the eight output ports 72 of each of the twelve AZ-plane networks 71 feed eight respectively corresponding input ports 15 of eight radiator unit cells 10A. The array thus includes a total of 192 radiator unit cells 10A. The half-networks 91 and 91A are suitably separated in the AZ direction to support the aforementioned 9.6 mm AZ-direction spacing between the eighth and ninth radiator unit cells 10A of each row.

Figure 11:
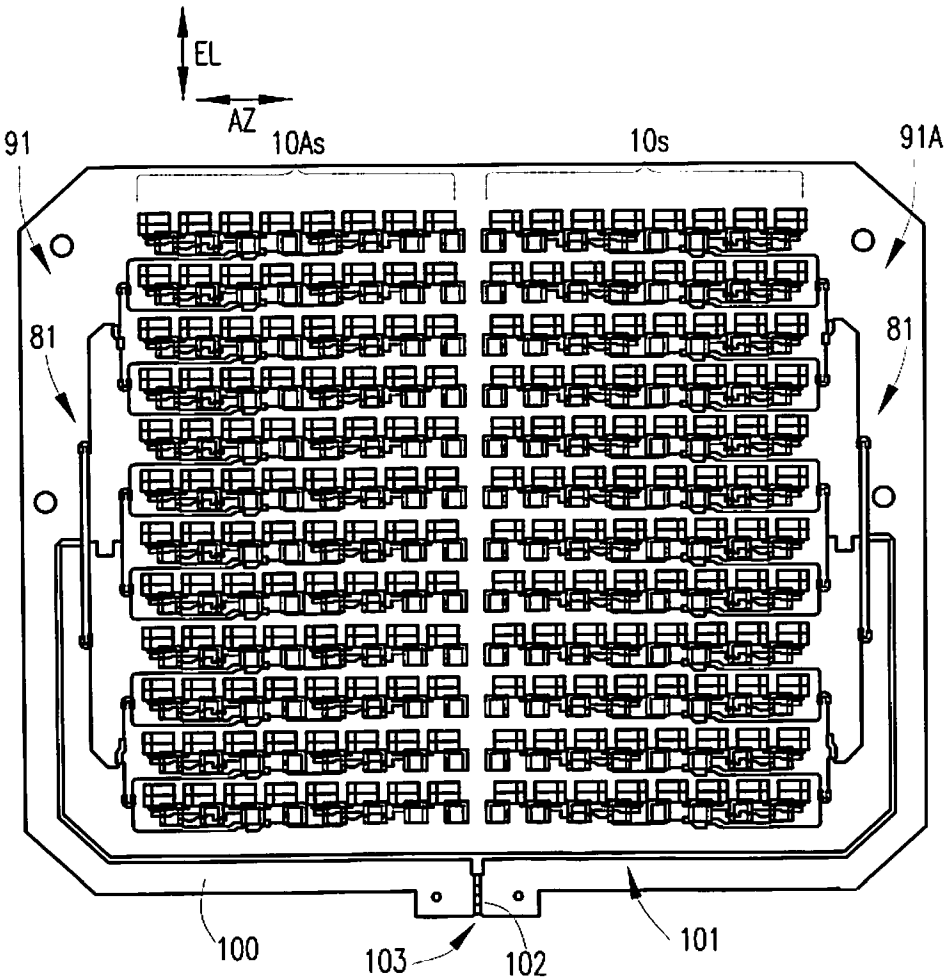

FIG. 11 diagrammatically illustrates an array generally similar to that of FIG. 10, except the right half of the array is populated with radiator unit cells having the configuration shown at 10 in FIG. 1. Thus, the radiator unit cells of the right half of the array are configured as mirror images of the radiator unit cells 10A that populate the left half of the array. With this configuration, the input port 102 of the entry feed network portion 101 is located exactly at the center of the array, which is not the case with the arrangement of FIG. 10.

As shown at 103 in FIGS. 10-12B, some embodiments provide a cutout in the stripline (see also FIG. 2) at the input port 102 of the entry feed network 101. This stripline cutout 103 significantly improves the input match when a conventional SMA-to-tab connector is attached. FIG. 12A is a partial diagrammatic top view (not to scale) of an antenna array such as in FIG. 10 or 11, with all layers above the stripline feed 61 (see also FIG. 2) removed for clarity of exposition. In some embodiments, the stripline cutout 103 generally defines a three-dimensional rectangular space, having a depth (in the EL direction) of approximately 0.35 mm, a width (in the AZ direction) of approximately 3 mm, and a height (in the direction H of FIG. 12B) approximately equal to the thickness of the stripline dielectric (2×31 mil=62 mil in the example of FIG. 2) plus 0.5 mm extensions into the upper and lower ground metal layers 51 and 21, respectively, of the stripline (see also FIG. 2). The total height dimension is thus approximately 62 mil+1 mm.

Figure 12A:
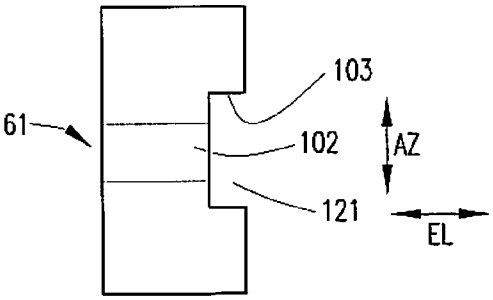
FIGS. 12A and 12B diagrammatically illustrate a stripline cutout portion of the antenna arrays of FIGS. 10 and 11 according to exemplary embodiments of the invention.
Figure 12B:
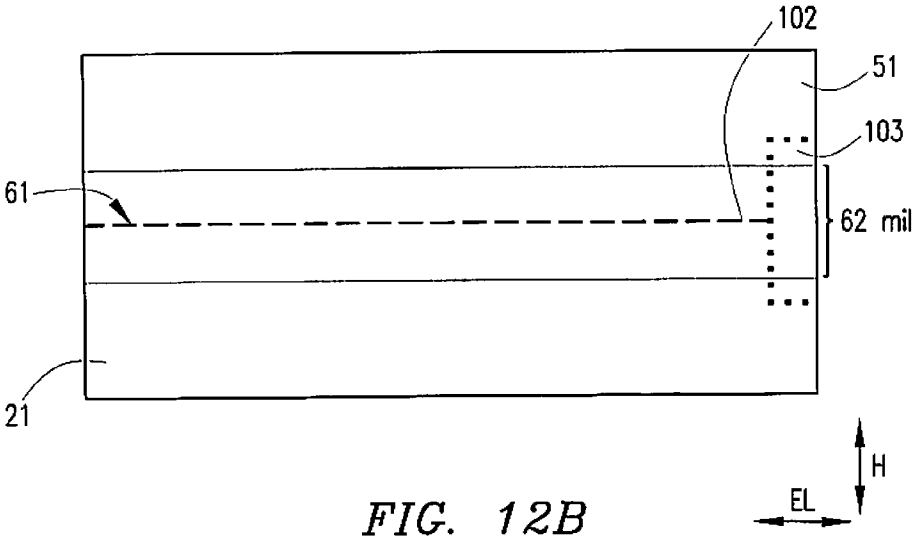

FIG. 12B is a partial diagrammatic side view (not to scale) of the antenna array of FIG. 12A, showing the cutout 103 as viewed along the AZ direction of FIG. 12A (which extends generally perpendicularly into the page in FIG. 12B). The chain lines and dotted lines are hidden lines that respectively represent the stripline feed 61 and cutout 103 of FIG. 12A. As can be seen from FIGS. 12A and 12B, the cutout 103 is generally centered on the input port 102 (which is defined within the stripline feed 61), relative to the H and AZ directions. When the SMA-to-tab connector is mounted to the antenna array structure, the cutout 103 provides an air space 121 between the connector and the stripline portion of the antenna array structure, bounded on five sides by the cutout 103, and on the sixth side by the mounting surface of the connector. The metal tab portion of the connector extends through the air space 121 in the EL direction and engages against the input port 102.

Figure 13:
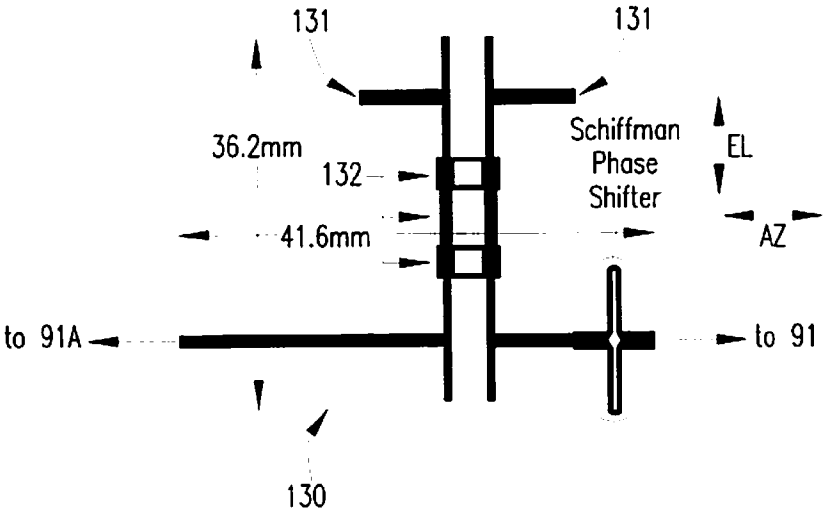
FIG. 13 diagrammatically illustrates a two-dimensional monopulse antenna array according to exemplary embodiments of the invention.

FIG. 13 diagrammatically illustrates a monopulse antenna array according to exemplary embodiments of the invention. The monopulse antenna array of FIG. 13 uses the basic array structure of FIG. 10, but replaces the input port 102 and the T-split portion of the entry feed network 101 with a stripline 0°/180° comparator 130. The 0°/180° comparator 130 has a pair of input ports 131 (50 ohm ports in some embodiments) that feed a triple-box wideband 0°/90° branchline coupler 132. The three loops of the branchline coupler 132 provide wideband performance. The branch feeding one of the half-network portions of FIG. 10 (half-network portion 91 in this example) includes a 90° Schiffman phase shifter that introduces an additional 90° of delay over the desired wideband performance range. The arrangement shown in FIG. 13 is thus capable of achieving desired phasing between the left and right halves of the array. Some embodiments provide a stripline cutout 103 (as described above with respect to FIGS. 10-12B) at each of the input ports 131 to improve input matching when SMA-to-tab connectors are attached.

It will be noted that the radiator unit cells 10/10A are essentially modular components in the arrays of FIGS. 10, 11 and 13, such that a single row of the unit cells (or half-row in FIG. 11) may simply be duplicated fifteen times when fabricating the arrays.

Although exemplary embodiments have been described above in detail, this does not limit the scope of the invention, which can be practiced in a variety of embodiments.

APPENDIX

Taylor-Weighted Coefficients

| | | | | | | | | | | | | | | | |
|---|---|---|---|---|---|---|---|---|---|---|---|---|---|---|---|
| 0.0307 | 0.0434 | 0.0681 | 0.0961 | 0.1244 | 0.1497 | 0.1687 | 0.1789 | 0.1789 | 0.1687 | 0.1497 | 0.1244 | 0.0961 | 0.0681 | 0.0434 | 0.0307 |
| 0.0532 | 0.0751 | 0.1179 | 0.1663 | 0.2152 | 0.2590 | 0.2920 | 0.3096 | 0.3096 | 0.2920 | 0.2590 | 0.2152 | 0.1663 | 0.1179 | 0.0751 | 0.0532 |
| 0.0879 | 0.1241 | 0.1949 | 0.2750 | 0.3558 | 0.4282 | 0.4828 | 0.5120 | 0.5120 | 0.4828 | 0.4282 | 0.3558 | 0.2750 | 0.1949 | 0.1241 | 0.0879 |
| 0.1248 | 0.1762 | 0.2767 | 0.3904 | 0.5051 | 0.6079 | 0.6853 | 0.7268 | 0.7268 | 0.6853 | 0.6079 | 0.5051 | 0.3904 | 0.2767 | 0.1762 | 0.1248 |
| 0.1549 | 0.2187 | 0.3435 | 0.4847 | 0.6270 | 0.7546 | 0.8507 | 0.9022 | 0.9022 | 0.8507 | 0.7546 | 0.6270 | 0.4847 | 0.3435 | 0.2187 | 0.1549 |
| 0.1717 | 0.2424 | 0.3807 | 0.5372 | 0.6950 | 0.8364 | 0.9430 | 1.0000 | 1.0000 | 0.9430 | 0.8364 | 0.6950 | 0.5372 | 0.3807 | 0.2424 | 0.1717 |
| 0.1717 | 0.2424 | 0.3807 | 0.5372 | 0.6950 | 0.8364 | 0.9430 | 1.0000 | 1.0000 | 0.9430 | 0.8364 | 0.6950 | 0.5372 | 0.3807 | 0.2424 | 0.1717 |
| 0.1549 | 0.2187 | 0.3435 | 0.4847 | 0.6270 | 0.7546 | 0.8507 | 0.9022 | 0.9022 | 0.8507 | 0.7546 | 0.6270 | 0.4847 | 0.3435 | 0.2187 | 0.1549 |
| 0.1248 | 0.1762 | 0.2767 | 0.3904 | 0.5051 | 0.6079 | 0.6853 | 0.7268 | 0.7268 | 0.6853 | 0.6079 | 0.5051 | 0.3904 | 0.2767 | 0.1762 | 0.1248 |
| 0.0879 | 0.1241 | 0.1949 | 0.2750 | 0.3558 | 0.4282 | 0.4828 | 0.5120 | 0.5120 | 0.4828 | 0.4282 | 0.3558 | 0.2750 | 0.1949 | 0.1241 | 0.0879 |
| 0.0532 | 0.0751 | 0.1179 | 0.1663 | 0.2152 | 0.2590 | 0.2920 | 0.3096 | 0.3096 | 0.2920 | 0.2590 | 0.2152 | 0.1663 | 0.1179 | 0.0751 | 0.0532 |
| 0.0307 | 0.0434 | 0.0681 | 0.0961 | 0.1244 | 0.1497 | 0.1687 | 0.1789 | 0.1789 | 0.1687 | 0.1497 | 0.1244 | 0.0961 | 0.0681 | 0.0434 | 0.0307 |

What is claimed is:

1. A layered radiator apparatus for radiating synthetic aperture radar (SAR) signals, comprising:

a layered input portion including a stripline feed disposed between a pair of ground layers, one of said ground layers defining therein a first slot;

a layered microstrip portion stacked adjacent said one ground layer, said microstrip portion including a microstrip disposed between a pair of dielectric layers; and a layered antenna portion stacked adjacent said microstrip portion, said antenna portion including a patch radiator defining therein a second slot, and a further dielectric layer disposed between said patch radiator and said microstrip portion;

wherein each of said stripline feed and said microstrip portion includes a plurality of conductive elements that are physically separated from one another and electrically isolated from one another, and wherein said first slot is in overlapping relationship relative to all of said conductive elements.

2. The apparatus of claim 1, wherein said conductive elements cooperate with said first slot for transferring signaling from said stripline feed to said microstrip and for applying a filtering operation to said transferred signaling.

3. The apparatus of claim 2, wherein said filtering operation is a passband-flattening operation.

4. The apparatus of claim 2, wherein said conductive elements of one of said microstrip portion and said stripline feed completely overlap said conductive elements of the other of said microstrip portion and said stripline feed.

5. The apparatus of claim 4, wherein said first and second slots are in non-overlapping relationship relative to one another.

6. The apparatus of claim 1, wherein said first and second slots are in non-overlapping relationship relative to one another.

7. The apparatus of claim 1, including a dielectric cover stacked adjacent said patch radiator opposite said further dielectric layer.

8. The apparatus of claim 1, wherein said first slot is generally H-shaped.

9. The apparatus of claim 8, wherein said second slot is generally U-shaped.

10. The apparatus of claim 1, wherein said second slot is generally U-shaped.

11. An antenna array apparatus, comprising:

a stacked arrangement of generally planar layers;

a generally planar array of patch radiators embedded between first and second generally planar dielectric layers of said stacked arrangement; and a stripline feed network coupled to said patch radiators and embedded between third and fourth generally planar dielectric layers of said stacked arrangement, said stripline feed network including an input portion adapted to be connected to an external connector when the external connector is mounted to the antenna array apparatus, said third and fourth dielectric layers defining therein adjacent said input portion a cutout that provides an air space through which an engagement portion of the external connector extends to engage against said input portion when the external connector is mounted to the antenna array apparatus;

wherein each of said first and second generally planar dielectric layers is physically separated from each of said third and fourth generally planar dielectric layers in said stacked arrangement.

12. The apparatus of claim 11, wherein said stacked arrangement includes generally planar ground layers respectively provided on said third and fourth dielectric layers opposite said stripline feed network, said ground layers defining therein a portion of said cutout.

13. The apparatus of claim 12, wherein one of said ground layers has defined therein a plurality of slots for transferring power from said stripline feed network to respectively corresponding ones of said patch radiators.

14. The apparatus of claim 13, wherein said stacked arrangement includes a generally planar microstrip layer having a plurality of microstrips disposed between respective ones of said slots and the respectively associated patch radiators, said microstrips cooperable with the respective slots for transferring power from said stripline feed network to the respective patch radiators.

15. The apparatus of claim 13, wherein said slots are generally H-shaped.

16. The apparatus of claim 11, wherein the external connector is an SMA-to-tab connector, and the engagement portion is the tab of the SMA-to-tab connector.

17. An antenna array apparatus, comprising:

a stacked arrangement of generally planar layers;

a generally planar array of patch radiators embedded between first and second generally planar dielectric layers of said stacked arrangement; and a stripline feed network coupled to said patch radiators and embedded between third and fourth generally planar dielectric layers of said stacked arrangement, said stripline feed network including an input portion adapted for connection to an external connector and to split power received from the external connector to feed respective portions of said stripline feed network evenly, wherein said input portion is configured as a 0°/180° comparator;

wherein each of said first and second generally planar dielectric layers is physically separated from each of said third and fourth generally planar dielectric layers in said stacked arrangement.

18. The apparatus of claim 17, wherein said 0°/180° comparator includes a pair of input ports and a pair of output branches, said input ports respectively coupled to said output branches by a 0°/90° branchline coupler, said output branches connected to feed said portions of said stripline feed network, one of said output branches including a 90° Schiffman phase shifter.

19. The apparatus of claim 18, wherein said branchline coupler is a triple-box branchline coupler.

20. The apparatus of claim 17, wherein said stripline feed network implements Taylor-weighted power distribution among said patch radiators.

21. A reactively-matched stripline feed network for feeding an array of patch radiators, comprising:

an input port;

a balanced, splitting T-junction fed by said input port and having a pair of output branches;

a pair of relatively less unbalanced, splitting T-junctions respectively fed by said output branches, each of said relatively less unbalanced, splitting T-junctions having a relatively higher power output branch and a relatively lower power output branch;

a pair of relatively more unbalanced, splitting T-junctions respectively fed by said relatively lower power output branches of said relatively less unbalanced, splitting T-junctions; and a balanced, combining T-junction having first and second input branches respectively coupled to said relatively higher power output branches of said relatively less unbalanced, splitting T-junctions and having a single output branch that recombines the power carried by said relatively higher power output branches.

22. The stripline feed network of claim 21, wherein each of said relatively more unbalanced, splitting T-junctions includes a quarter-wave transforming neck coupled between an input thereof and a pair of output branches thereof, each said quarter-wave transforming neck configured to extend alongside and generally parallel to a relatively lower power one of the associated output branches.

23. The stripline feed network of claim 22, configured to implement Taylor-weighted power distribution among the array of patch radiators.

24. The stripline feed network of claim 21, configured to implement Taylor-weighted power distribution among the array of patch radiators.

* * * * *